United States Patent [19]

Rao et al.

[11] Patent Number: 4,575,697

[45] Date of Patent: Mar. 11, 1986

[54] ELECTRICALLY CONTROLLED PHASE SHIFTER

[75] Inventors: Basrur R. Rao, Lexington; Chris J. Daigle, Littleton, both of Mass.

[73] Assignee: Sperry Corporation, New York, N.Y.

[21] Appl. No.: 621,838

[22] Filed: Jun. 18, 1984

[51] Int. Cl.[4] ..... H01P 1/18

[52] U.S. Cl. ..... 333/157; 310/331; 333/159; 333/248

[58] Field of Search ..... 333/81 B, 156, 157, 333/159, 259, 248; 310/330, 331

[56] References Cited

U.S. PATENT DOCUMENTS 2,836,737 5/1958 Crownover ..... 310/331
4,450,375 5/1984 Siegal ..... 310/331

FOREIGN PATENT DOCUMENTS 591369 8/1947 United Kingdom ..... 333/159

*Primary Examiner*—Marvin L. Nussbaum
*Attorney, Agent, or Firm*—Howard P. Terry

[57] ABSTRACT

A microwave phase shifter for use in waveguide transmission line employs a piezoelectric cantilevered bimorph member mounted on the waveguide and a thin wafer of dielectric material mounted on the free end of the cantilever above a slot in the waveguide. Voltages applied to the bimorph member cause this member to distort so as to insert the wafer into the waveguide slot and alter the phase of the microwave signal being transmitted.

9 Claims, 3 Drawing Figures

ELECTRICALLY CONTROLLED PHASE SHIFTER

BACKGROUND OF THE INVENTION

1. Field of the Invention

The present invention relates to electrical phase shifters and more specifically to electrically variable phase shifters for use in waveguide transmission systems.

2. Description of the Prior Art

A need frequently arises for variable phase shifters for use in microwave transmission systems.

For instance, there is presently a great deal of interest in developing electronically scanning antenna arrays to replace mechanically scanned antennas in existing microwave radar installations since it is believed that the performance, cost, and weight of the existing antennas could be improved significantly by using electronic scanning. It has been proposed that electronic scanning could be accomplished by utilizing a low loss, electrically variable phase shifter in the antenna's transmission system to accomplish this purpose.

Typically, antennas of the type under consideration may operate at 94 GHz (W-band). Feritte phase shifter are known in the art which may be used at this frequency, but they exhibit high losses. Furthermore, the transverse dimensions of these devices are relatively large, typically being of the order of 2 cm in diameter. Since the distance between adjacent elements in W-band components may be in the order of 1.5 mm, the size of the ferrite devices makes it difficult to incorporate these devices into such arrays.

PIN diodes capable of operating at W-band frequencies are known in the art and may be employed with sections of waveguide to provide digital phase shifters. However, the insertion loss of these diodes is high and the diodes are susceptible to burnout at high power. For example, the insertion loss of a 4 bit PIN diode-waveguide phase shifter at millimeter wave frequencies, may be as high as 4–6 dB.

Still other approaches toward achieving the desired phase shift have been reported in the literature. Modulating the width of a waveguide with semiconductor, for instance, has been described in an article entitled "Millimeter Wave Phase Shifter" by B. J. Levin and G. G. Weidner and appearing on pp. 489–505 of the RCA Review, Vol. 34, 1973.

An article entitle "Optical Control of Millimeter Wave Propagation in Dielectric Waveguides" written by C. H. Lee et al and published in the IEEE Journal of Quantum Electronics, Vol. QE-16, NO. 3 for March 1980 describes a technique for modulating the conductivity of a semiconductor through the use of a laser.

Unfortunately, however, the results achieved using these latter two methods appear to indicate that these techniques also suffer from relatively high losses.

As opposed to the prior art devices, the insertion loss of a phase shifter constructed in accordance with the present invention typically displays an insertion loss of less than 0.5 dB for 360° of a phase shift.

Furthermore, the transverse dimensions of the present phase shifter can be made as small as the width of a W-band waveguide (0.45 cm) so that the phase shifter can be readily incorporated in a planar array for electronic scanning.

In addition, the phase shifter of the present invention is relatively inexpensive, easy to fabricate, and requires very little driver power.

SUMMARY OF THE INVENTION

An electrically-controlled, continuously variable millimeter wave phase shifter utilizes the voltage-induced bending motion of a multi-layer bimorph element made from a piezoelectric material to achieve the desired phase shift by controlling the depth of insertion of a fused quartz wafer inside a slotted waveguide.

DESCRIPTION OF THE PREFERRED EMBODIMENTS

Figure 1:
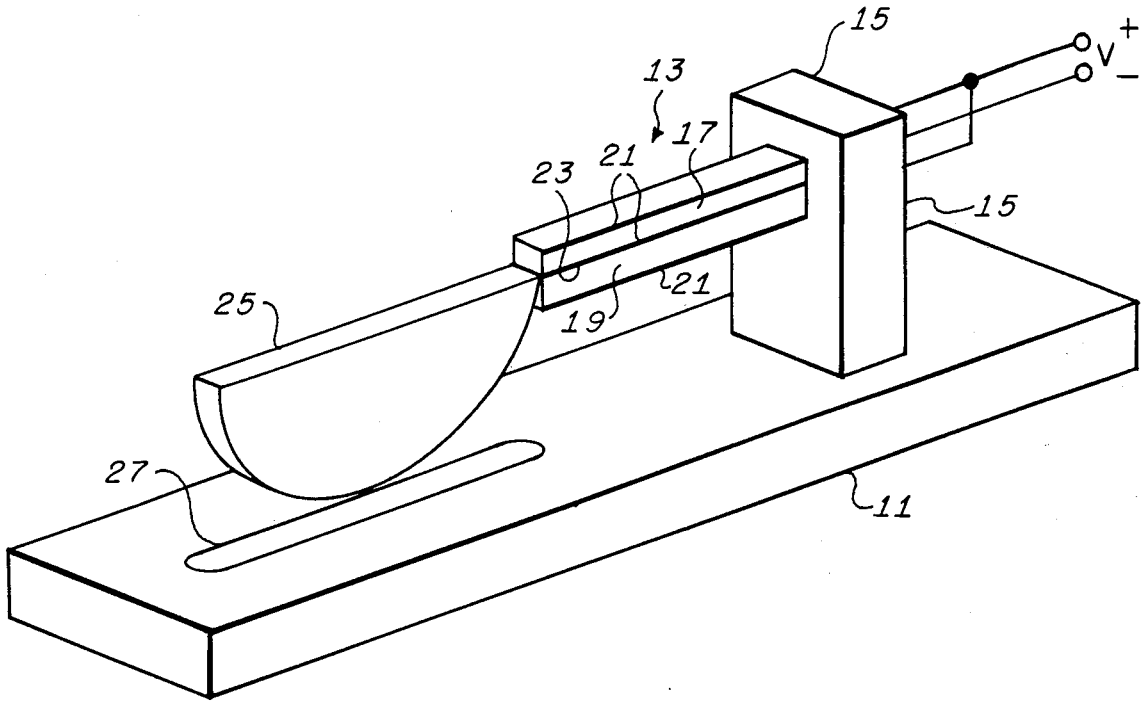
FIG. 1 is a partially schematic diagram illustrating a phase shifter constructed in accordance with the principles of the invention.

Referring now to FIG. 1, a phase shifter for use in a rectangular wavequide 11 includes a piezoelectric bimorph cantilever element 13 mounted in a clamping member 15 which is secured to a broad wall of the waveguide. As illustrated, the bimorph element 13 inlcudes an upper piezoelectric layer 17 and a lower oppositely polarized layer 19. The upper and lower surfaces of each piezoelectric layer are supplied with thin flexible electrodes 21 and bonded together by a suitable bonding agent such as an epoxy layer 23.

Various piezoelectric materials may be used for the individual layers. Commercially available polyvinylidene fluoride (PVDF) films, for instance, have been found to operate satisfactorily.

The bimorph element 13 rigidly supports a dielectric fin 25 over a slot 27 formed in the upper wall of the waveguide and proportioned to receive the fin 25.

As will be explained, during normal operation, the dielectric fin is inserted through slot 27 into the waveguide 11. Insertion of the dielectric fin serves to decrease the guide wavelength and thus modify the phase of signals propagating through the guide.

As presently preferred, the fin may be constructed as a thin semicircular wafer of fused quartz, although various other low loss materials such as "Teflon" may be used for this purpose.

As indicated in FIG. 1, the bimorph element is actuated from a voltage source V having one of its terminals connected to the outer electrodes of the bimorph element and its other terminal connected to the inner electrodes of the element.

Figure 2:
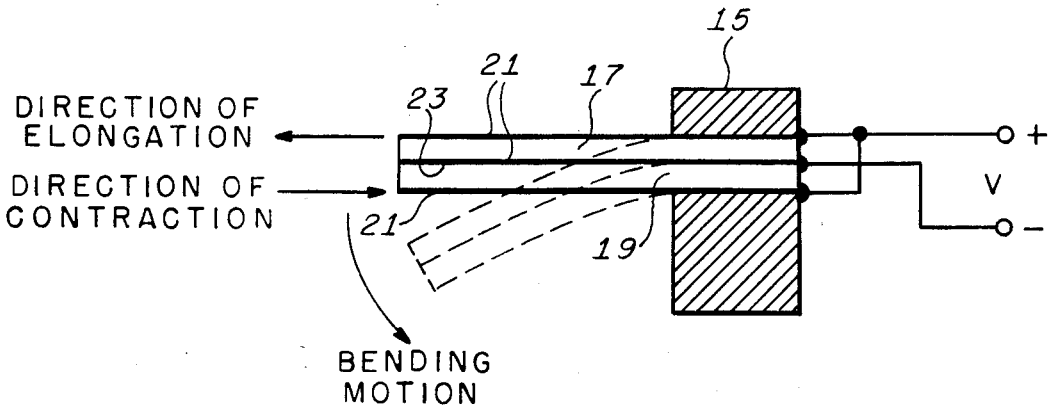
FIG. 2 is a diagram useful in explaining the invention.

FIG. 2 illustrates the action of the bimorph element in response to an applied voltage. Since the individual piezoelectric layers are oppositely polarized, a suitable applied voltage causes the upper piezoelectric layer to expand and the lower layer to contract, resulting in a downward curvature of the bimorph element as illustrated in FIG. 2, and serving to insert the dielectric fin into the slot 27 to a depth which is a function of the applied voltage.

It can be shown that the deflection of the bimorph element is proportional to the piezoelectric strain coefficient of the particular bimorph element and the applied voltage. The phase shift is proportional to the length, thickness, dielectric constant, and depth of insertion of the dielectric fin attached to the bimorph element.

The dielectric fin is shaped to reduce reflections and minimize insertion loss. As presently preferred, a substantially semicircular shaped fin fulfills these requirements.

If desired, the bimorph element can be made mechanically more rugged by using a multi-layer bimorph structure. If the number of layers is increased by a factor of N, the displacement of the free end of the bimorph element will be reduced by a factor of 1/N, but the total force exerted will be increased by a factor $N^2$.

A prototype model of a phase shifter employing the principles of the invention was assembled and tested using commericially available polarized PVDF strips metallized with aluminum for the bimorph laminate. The bimorph element was constructed to have a length of 2 inches (5.08 cm), a width of approximately 0.25 inches (0.635 cm), and a thickness of 0.008 inches (0.02 cm). The waveguide had inside dimensions of 0.100×0.050 inches (0.254×0.127 cm). An approximately semicircular fused quartz wafer having a thickness of 0.007 inches (0.18 cm) and a length of 0.5 inches (1.27 cm) was mounted above a slot having a length of 0.6 inches (1.524 cm) and a width of 0.025 inches (0.064 cm).

Figure 3:
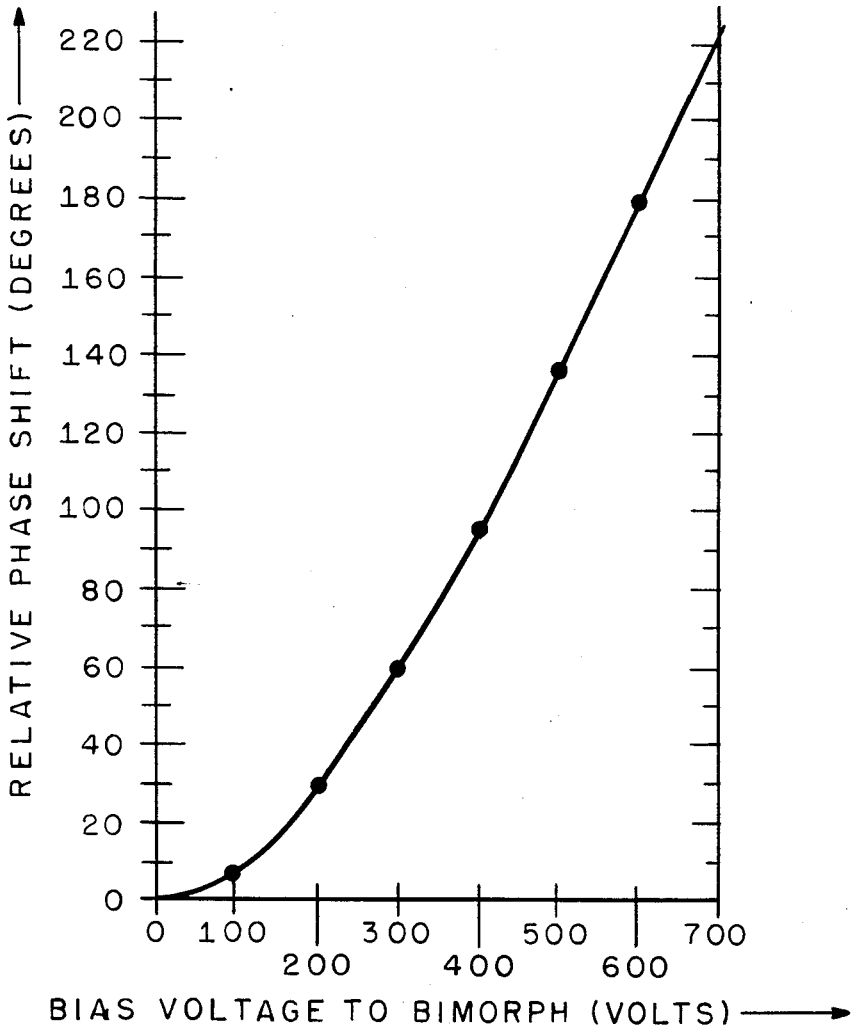
FIG. 3 is a graphical representation of the operating characteristics of a phase shifter employing the principles of the invention.

Tests on the aforementioned prototype operating at 94 $GH_Z$ produced the results depicted in FIG. 3 which shows the measured phase shift as a function of the bias voltage applied to the bimorph. For a bias voltage of 600 V, the phase shift was 180° as depicted in FIG. 3. The insertion loss measured under these conditions was less than 0.2 dB, although the insertion loss increased to about 0.5 dB with maximum insertion of the dielectric fin.

As indicated previously, the dielectric fin of the prototype consisted of a fused quartz wafer having an approximately semicircular contour. It will be appreciated by those skilled in the art that the contour of the fin can be modified through straightforward design techniques to provide a wide range of phase shift versus bias voltage characteristic curves.

Similarly, the rise in insertion loss experienced with the prototype when the dielectric fin was inserted to its maximum depth could be ameliorated by modifying the contour of the fin. A Tchebysheff type of taper, for instance, would cause a substantial decrease in reflection at complete penetration and provide a lower insertion loss under these conditions.

While the invention has been described in its presently preferred embodiments, it is to be understood that the words which have been used are words of description rather than limitation and that changes may be made within the purview of the appended claims without departing from the true scope and spirit of the invention in its broader aspects.

We claim:

1. An electrically variable phase shifter for use in a microwave transmission system comprising a section of waveguide having a longitudinal axis and a wall with a narrow slot therein parallel to said waveguide section longitudinal axis, a piezoelectric element constructed to bend in response to applied voltages and cantileveredly mounted externally to said waveguide section adjacent said wall, thereby having a free end, means for applying a variable voltage to said piezoelectric element to cause bending of said element as a function of said variable voltage, a dielectric fin constructed to include a thin wafer of fused quartz attached to said free end of said piezoelectric element and positioned relative to said narrow longitudinal slot for movement therethrough when said piezoelectric element is bent by said variable voltage.

2. The phase shifter of claim 1 wherein said piezoelectric element is shaped as a rectangular beam, mounted with its longitudinal axis parallel to said longitudinal axis of said waveguide section, and constructed and arranged to bend downward toward said waveguide wall in response to said variable voltage.

3. The phase shifter of claim 1 wherein the fused quartz is contoured to provide a gradual change in phase shift as the wafer is inserted in the slot.

4. The phase shifter of claim 3 wherein the contour of the wafer approximates a semicircle.

5. An electrically variable phase shifter for use in a microwave transmission system, said phase shifter comprising a section of rectangular waveguide, a multilayer piezoelectric bimorph element constructed in the form of a cantilevered beam mounted on one broad wall of the waveguide section, said bimorph element being fitted with electrodes arranged so that application of a variable bias voltage to these electrodes causes the bimorph element to bend downwardly towards the waveguide surface as a function of the magnitude of the bias voltage, said phase shifter further including a fused quartz dielectric wafer rigidly attached to the free end of the bimorph member, said wafer being mounted in the plane of motion of the bimorph element, said waveguide section containing a longitudinal slot positioned and dimensioned to receive said wafer as bias voltages are applied to the electrodes of the bimorph element.

6. The phase shifter of claim 5 further characterized in that the bimorph element is mounted so that the axis of the cantilevered beam is parallel to the axis of the waveguide section.

7. The phase shifter of claim 6 in which the bimorph element is constructed from layers of polyvinylindene fluoride.

8. The phase shifter of claim 7 in which the bimorph element consists of an upper and a lower layer of piezoelectric polyvinylidene fluoride, said upper and lower layers being bonded together through a common electrode arranged to be connected to one terminal of a source of bias voltage, the outer surfaces of the upper and lower layers being coated with individual electrodes that can be coupled to the second terminal of a source of bias voltage.

9. The phase shifter of claim 8 further characterized in that the upper and lower layers of the bimorph element are oppositely polarized so that application of a bias voltage causes the upper layer to lengthen and the lower layer to shorten.

* * * * *